US009209585B2

(12) United States Patent
Houser et al.

(10) Patent No.: US 9,209,585 B2
(45) Date of Patent: Dec. 8, 2015

(54) CRIMPING TOOL HEAD

(75) Inventors: Matthew Steven Houser, Jamestown, PA (US); Eric Douglas Springston, II, Hershey, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 829 days.

(21) Appl. No.: 12/708,055

(22) Filed: Feb. 18, 2010

(65) Prior Publication Data

US 2011/0197648 A1 Aug. 18, 2011

(51) Int. Cl.
*H01R 43/042* (2006.01)

(52) U.S. Cl.
CPC ..... *H01R 43/0427* (2013.01); *H01R 43/042* (2013.01)

(58) Field of Classification Search
CPC ..... H01R 43/042; H01R 43/058; H01R 43/0427; B21D 5/02; B21D 97/02; B21D 1/14; B25B 27/10; B25B 27/146; B25B 7/02; B25B 7/12; B25B 7/00; B25B 27/06; B25B 7/10; B25B 7/123; B42F 17/02
USPC ..... 72/409.16, 414, 416, 409.1, 409.07, 72/409.08, 409.09, 409.19, 409.11, 72/409.12, 409.13, 412, 413, 453.01, 72/453.15, 453.16; 81/342, 345; 29/237, 29/282
See application file for complete search history.

(56) References Cited

U.S. PATENT DOCUMENTS

| | | | | |
|---|---|---|---|---|
| 2,113,087 | A * | 4/1938 | Jensen | 72/416 |
| 2,762,414 | A * | 9/1956 | Demler | 72/413 |
| 3,903,725 | A * | 9/1975 | Rommel | 72/409.09 |
| 5,253,508 | A * | 10/1993 | Bakermans | 72/431 |
| 6,026,671 | A * | 2/2000 | Battenfeld | 72/409.12 |
| 6,230,542 | B1 * | 5/2001 | Frenken | 72/456 |
| 6,532,790 | B2 * | 3/2003 | Frenken | 72/456 |
| 6,564,610 | B2 * | 5/2003 | Lefavour et al. | 72/453.16 |
| 6,792,789 | B1 | 9/2004 | Faucher | |
| 7,124,619 | B1 * | 10/2006 | Lefavour et al. | 72/456 |
| 2001/0007202 | A1 * | 7/2001 | Frenken | 72/416 |
| 2012/0260714 | A1 * | 10/2012 | Hutchfield et al. | 72/409.1 |

FOREIGN PATENT DOCUMENTS

EP 1 270 959 1/2003

OTHER PUBLICATIONS

European Search Report, Mail Date Apr. 29, 2011, EP 11 15 4971, Application No. 11154971.3-1231.

* cited by examiner

*Primary Examiner* — Shelley Self
*Assistant Examiner* — Lawrence Averick

(57) ABSTRACT

A crimping tool includes a frame holding first and second crimping dies within a crimping zone. The frame has an opening providing access to the crimping zone. A ram is coupled to the first die and is configured to drive the first die toward the second die. A swinging arm is rotatably coupled to the frame between an open position and a closed position. The swinging arm closes the opening in the frame when in the closed position. The swinging arm has a pivot end pivotably coupled to the frame and a distal end opposite to the pivot end. The distal end engages the frame when in the closed position. A biasing member coupled to the swinging arm to bias the swinging arm toward the closed position to close the opening.

24 Claims, 8 Drawing Sheets

CRIMPING TOOL HEAD

BACKGROUND OF THE INVENTION

The subject matter herein relates generally to crimping tool heads, and more particularly, to crimp tool heads having latching elements.

Pressing devices are employed in numerous applications to provide a user with a desired mechanical advantage. One exemplary application is in crimping tools used for making crimping connections, such as crimping terminals onto conductors. The crimping tool typically includes a tool head having tooling appropriate for the particular application, and an actuator connected to the tool head for driving the tooling. The tool head typically includes a fixed die and movable die that is driven towards the fixed die to perform the crimping operation. The actuator may be hydraulically driven and include a hydraulic pump that is operated to either directly or indirectly drive the movable die of the work head. Other actuation means, such as a hand-powered handle assembly, are possible.

Known crimping tools typically have one of three different types of tool heads, namely an open tool head, a closed tool head, and a latching type tool head. Each of the different types of tool heads has certain advantages and disadvantages. The open tool head is generally C-shaped with an open side. The crimped terminal and the corresponding wire may be removed from the tool head through the open side after the crimping operation. As such, the open tool head type may be used to terminate two wires together with a terminal. The component may be removed through the open side, as opposed to the closed tool head type, which cannot be used to terminate two wires together with a terminal because there is no way to remove the component from the closed tool head after the two wires are connected together. However, the open tool head is not without disadvantages. For instance, the open tool head is larger and more robust, and thus heavier, to overcome the stresses imparted on the frame of the open tool head during the crimping operation. For example, during the crimping operation, the crimping forces push against the outer arm of the frame, which forces the C-shaped frame to spread apart. The forces on the frame over time may eventually damage the frame and ultimately lead to failure of the frame. The frame is made bulkier than other types of tool heads to overcome the problems with damage and failure. The added bulk of the frame makes the tool head heavier and more difficult for the operator to hold. Also, the operator may fatigue more quickly using the open tool head type as compared to other types.

The closed tool head type has a more stable structure than the open tool head type. The frame can be made from less material, while still providing the same or better structural integrity than the open tool head type. As such, the frame may be lighter and less expensive to manufacture. However, as noted above, the closed tool head is limited in the types of crimp connections that may be made by the tool head. For example, the closed tool head type can not be used to crimp a splice between two wires, as the completed wire assembly can not be removed from the crimping zone in a convenient manner, if at all.

The latching tool head type has characteristics of both the open and closed tool head types. The latching tool head typically includes two pieces that may be moved relative to one another such that the tool head can be opened and closed. When open, the terminal and wire can be easily removed from the crimping zone. When closed, the two pieces close the opening, forming a similar structure as the closed head type for performing the crimping operation. The latching tool heads are not without disadvantages. For instance, one or both of the pieces must be physically closed and opened by the operator before and after each crimping process. This task is time consuming. Additionally, the mechanism that allows the two pieces to open and close may be complex to design, manufacture and assemble, which makes the tool head more expensive. The latching mechanism that holds the two pieces together may also be complex.

BRIEF DESCRIPTION OF THE INVENTION

In one embodiment, a crimping tool is provided that includes a frame holding first and second crimping dies within a crimping zone. The frame has an opening providing access to the crimping zone. A ram is coupled to the first die and is configured to drive the first die toward the second die. A swinging arm is rotatably coupled to the frame between an open position and a closed position. The swinging arm closes the opening in the frame when in the closed position. The swinging arm has a pivot end pivotably coupled to the frame and a distal end opposite to the pivot end. The distal end engages the frame when in the closed position. A biasing member coupled to the swinging arm to bias the swinging arm toward the closed position to close the opening.

In another embodiment, a crimping tool is provided that includes a frame holding first and second crimping dies within a crimping zone. At least one of the crimping dies is movable during a crimping operation. The frame has a first arm and a second arm and defines an opening between the first and second arms. The opening provides access to the crimping zone. The second arm has a frame latching element. A swinging arm including a pivot end is pivotably coupled to the first arm of the frame. The swinging arm includes a distal end opposite to the pivot end. The swinging arm has a latching element configured to engage the frame latching element. The swinging arm is movable between an open position and a closed position. The distal end engages the second arm of the frame when in the closed position to close the opening. The second arm is movable away from the first arm during the crimping operation from an unseated position to a seated position. The frame latching element engages the latching element of the swinging arm when in the seated position to limit further movement of the second arm away from the first arm.

In a further embodiment, a crimping tool is provided that includes a frame holding first and second crimping dies within a crimping zone. The frame has a first arm and a second arm. The frame defines an opening providing access to the crimping zone between the first and second arms. A ram is coupled to the first die. The ram has a cam surface and is movable between a retracted position and an advanced position. The ram drives the first die toward the second die as the ram is moved to the advanced position. A swinging arm is provided that includes a pivot end pivotably coupled to the first arm of the frame and a distal end opposite to the pivot end. The swinging arm has a lever at the pivot end. The swinging arm is movable between an open position and a closed position. The distal end engages the second arm of the frame when in the closed position to close the opening. The cam surface of the ram is configured to engage the lever when the swinging arm is in the open position. The ram moves the swinging arm to the closed position as the ram is moved from the retracted position to the advanced position.

DETAILED DESCRIPTION OF THE INVENTION

Figure 1:
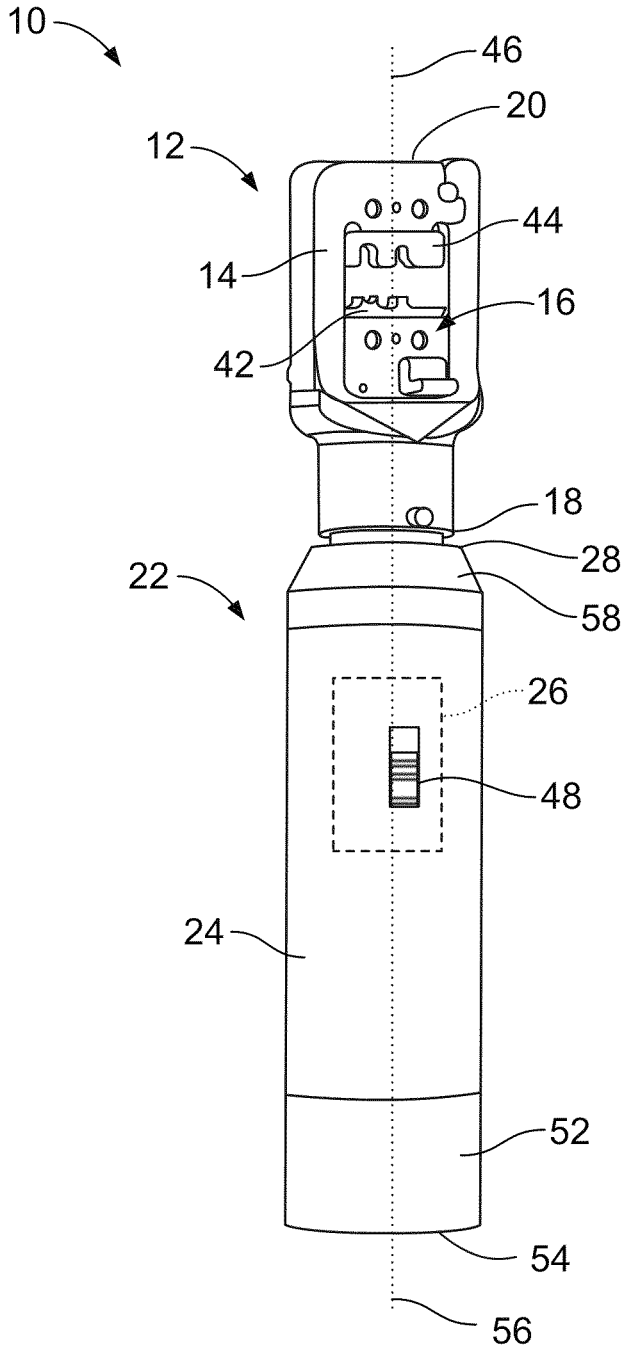
FIG. 1 illustrates a crimping tool formed in accordance with an exemplary embodiment.

FIG. 1 illustrates a crimping tool 10 formed in accordance with an exemplary embodiment. The crimping tool 10 includes a tool head 12 used for crimping components together, such as for crimping a terminal to a wire (not shown). Optionally, the tool head 12 may be used to terminate two wires together with a terminal, creating a completed wire assembly. Alternatively, the terminal may be terminated to the end of a single wire to create a completed wire assembly. The tool head 12 has a tool head frame 14 holding tooling 16. In an exemplary embodiment, the tool head 12 represents a latching type tool head. The tool head frame 14 may be closed during the crimping operation and opened after the crimping operation to remove the completed wire assembly. The tool head 12 includes a mating end 18 opposite to a head end 20.

The crimping tool 10 includes an actuator 22 having an actuator body 24 holding a hydraulic pump 26 (shown in phantom) that is operable to drive the tooling 16. The actuator 22 has a mating end 28. The tool head 12 is coupled to the mating end 28 of the actuator 22, such as by a threaded connection. The actuator 22 may utilize an alternative actuating means or device other than the hydraulic pump 26 in alternative embodiments, such as a screw driven by an electric motor. The hydraulic pump 26 is merely illustrative of an exemplary embodiment of an actuator component and the actuator 22 is not intended to be limited to using a hydraulic pump 26.

The tool head frame 14 holds the tooling 16. Optionally, the tooling 16 may be separate from the tool head frame 14 and coupled to the tool head frame 14. The tooling 16 may include first and second crimping dies 42, 44 within a crimping zone. In the illustrated embodiment, the first die 42 represents a movable die that may be referred to hereinafter as a movable die 42 and the second die 44 represents a fixed die that may be referred to hereinafter as a fixed die 44. The movable die 42 is movable with respect to the fixed die 44. Optionally, the tooling 16 may include multiple movable dies or components that are movable toward one another. The fixed and/or movable dies 44, 42 may be removed from the tool head frame 14 to replace damaged tooling and/or to utilize different types, sizes and/or shaped tooling. Alternatively, the tool head frame 14 may be removed from the actuator 22 and replaced with a different tool head frame having tooling with a different type or different sized and/or shaped tooling.

The actuator 22 is operated during a crimping operation to move the tooling 16 from a retracted position to an advanced position. For example, the movable die 42 is moved toward the fixed die 44 in an advancing direction. The terminal is crimped to the wire during the crimping operation. After the tooling is fully advanced, the tooling is moved in a retracting direction back to the retracted position.

The tool head frame 14 is generally cylindrical in shape at the mating end 18 for rotational threading to the actuator body 24, however the tool head frame 14 may have other shapes in alternative embodiments. The tool head frame 14 is generally rectangular in shape at the head end 20, however the tool head frame 14 may have other shapes in alternative embodiments. The tool head frame 14 extends along a longitudinal axis 46 extending between the mating end 18 and head end 20. Optionally, the movable die 42 may be moved in a driven direction generally along the longitudinal axis 46 during operation.

In an exemplary embodiment, an operation switch 48 may be provided on an outer surface of the actuator 22. The operation switch 48 controls the operation of the pressing device 10. For example, the operation switch 48 may be moved between an ON position and an OFF position wherein the movable die 42 is driven towards the fixed die 44 when the operation switch 48 is moved to the ON position. Optionally, the operation switch 48 may be provided on the tool head frame 14 rather than the actuator 22.

The actuator 22 includes the hydraulic pump 26 within the actuator body 24. The hydraulic pump 26 is operatively connected to a power source 52 at a base end 54. Optionally, the power source 52 may be a battery. Alternatively, the power source 52 may be an AC power source with a cord extending from the base end 54 of the actuator 22. The hydraulic pump 26 forms part of a hydraulic circuit that is used to actuate the tooling 16. In an exemplary embodiment, the pressing device 10 is an electrohydraulic pressing device wherein the hydraulic pump 26 is controlled by an electric motor that is powered by the power source 52.

The actuator body 24 is generally cylindrical in shape, however the actuator body 24 may have other shapes in alternative embodiments. For example, the shape of the actuator body 24 may be contoured to fit within an operator's hand. The actuator body 24 may be angled to balance or otherwise distribute the weight of the actuator body 24. The actuator body 24 extends along a longitudinal axis 56 extending between the mating end 28 and the base end 54. A coupler 58 may be provided at the mating end 28 of the actuator 22 for the purpose of attaching the tool head 12 to the actuator 22.

Figure 2:
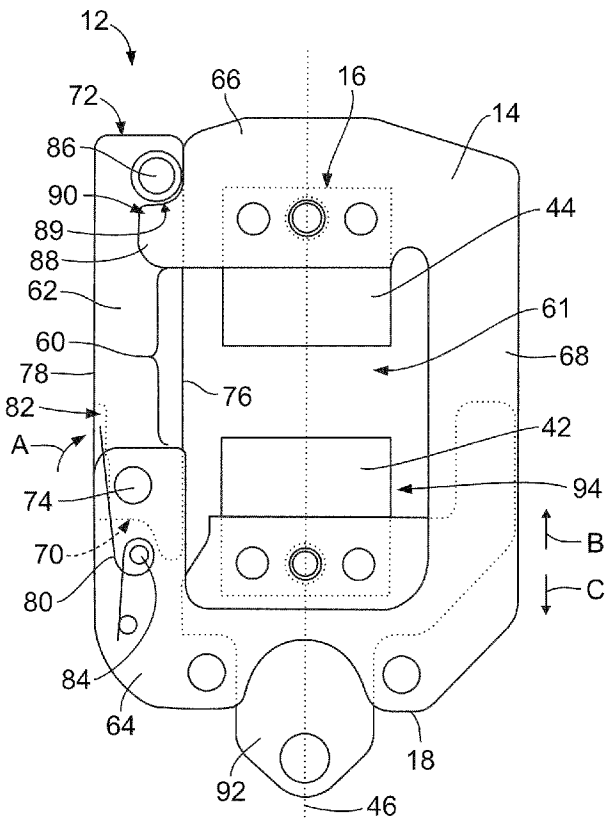
FIG. 2 is a front view of a tool head for the crimping tool shown in FIG. 1, with the tool head in a retracted state.

FIG. 2 is a front view of the tool head 12 for the crimping tool 10 (shown in FIG. 1), with the tool head 12 in a retracted state. The tool head frame 14 is illustrated. The frame 14 represents a latching type tool head frame 14 having an opening 60 providing access to a crimping zone 61. The frame 14 also includes a swinging arm 62 that is movable between an open position and a closed position to allow and restrict access, respectively, to the crimping zone 61. The swinging arm 62 is illustrated in the closed position. The swinging arm 62 can open to allow the wire(s) and the terminal to eject from the crimping zone 61 after the crimping process.

The frame 14 is generally C-shaped with a first arm 64 and a second arm 66. The first arm 64 defines an inner arm and the second arm 66 defines an outer arm positioned outward or further from the actuator 22 (shown in FIG. 1) than the first arm 64. The opening 60 is defined between the first and second arms 64, 66. A base 68 extends between the first and second arm 64, 66 opposite to the opening 60. The base 68 and first and second arm 64, 66 define the C-shaped body of the frame 14.

The swinging arm 62 is coupled to the frame 14 between the first and second arms 64, 66 to close the opening 60. The swinging arm 62 extends between a pivot end portion 70 and a distal end portion 72. The distal end portion 72 is configured to couple both the first and second arms 64, 66 when the swinging arm 62 is in the closed position. The pivot end portion 70 is rotatably coupled to the first arm 64. In an exemplary embodiment, the swinging arm 62 includes a pivot pin 74 extending therefrom at the pivot end portion 70. The pivot pin 74 is received in an opening in the frame 14. The swinging arm 62 rotates about the pivot pin 74. In an alternative embodiment, the pivot pin 74 may extend from the frame 14 and be received within an opening in the swinging arm 62. The swinging arm 62 includes an inner side 76 that faces the crimping zone 61 and an outer side 78 opposite to the inner side 76. Optionally, the inner side 76 may engage the frame 14 when the swinging arm 62 is in the closed position.

In an exemplary embodiment, a biasing member in the form of a spring 80 is positioned between the frame 14 and the swinging arm 62. The spring 80 provides a biasing force on the swinging arm 62 in a biasing direction, shown in FIG. 2 by the arrow A. The spring 80 biases the swinging arm 62 toward the closed position. The spring 80 helps force the swinging arm 62 to the closed position. Optionally, the spring 80 automatically closes the swinging arm 62. Optionally, the swinging arm 62 may include a pocket 82 that receives the spring 80 therein. The pocket 82 may be open at the outer side 78 to receive the spring 80. The spring 80 is held by one or more posts 84 of the frame 14. Other spring configurations are possible in alternative embodiments. Additionally, other types of biasing members, other than the spring, may be used to close the swinging arm 62.

The swinging arm 62 is moved to the closed position prior to or during the crimping operation. The swinging arm 62 is locked to the second arm 66 during the crimping operation to rigidly hold the second arm 66 relative to the first arm 64. In an exemplary embodiment, the swinging arm 62 includes a latching element 86 and the second arm 66 of the frame 14 includes a frame latching element 88. The latching element 86 and the frame latching element 88 engage one another during the crimping operation to lock the swinging arm 62 and the frame 14. The swinging arm 62 operates as a link between the first arm 64 and the second arm 66 to rigidly close the frame 14. In the illustrated embodiment, the latching element 86 represents a post and the frame latching element 88 includes a pocket 89 that receives the latching element 86. The latching element 86 may be cantilevered from the swinging arm 62. Alternatively, both ends of the latching element 86 may be supported by the swinging arm 62. The frame latching element 88 includes a flange portion 90 at a radially outer edge of the pocket 89. The flange portion 90 wraps at least partially around the latching element 86 to hold the latching element 86 within the pocket 89. Alternative latching configurations are possible in alternative embodiments to lock the swinging arm 62 and the second arm 66. For example, the latching element 86 may include a pocket and the frame latching element 88 may include a post received in the pocket. Other types of latches may be used to hold the swinging arm 62 and the second arm 66 together.

The tool head 12 includes a ram 92 coupled to the movable die 42. The frame 14 includes a ram cavity 94 between the first and second arms 64, 66. The ram 92 is movable within the ram cavity 94 between a retracted position, such as the position the illustrated in FIG. 2, and an advanced position. The ram 92 is movable along the longitudinal axis 46 in an advancing direction during the crimping operation, such as when the actuator 22 (shown in FIG. 1) is activated. The advancing direction is illustrated in FIG. 2 by the arrow B. The ram 92 drives the movable die 42 towards the fixed die 44 as the ram 92 is moved in the advancing direction to the advanced position. The terminal is crimped to the wire(s) as the movable die 42 is advanced towards the fixed die 44 during the crimping operation. The ram 92 is also movable along the longitudinal axis 46 in a retracting direction, which is illustrated in FIG. 2 by the arrow C.

Figure 3:
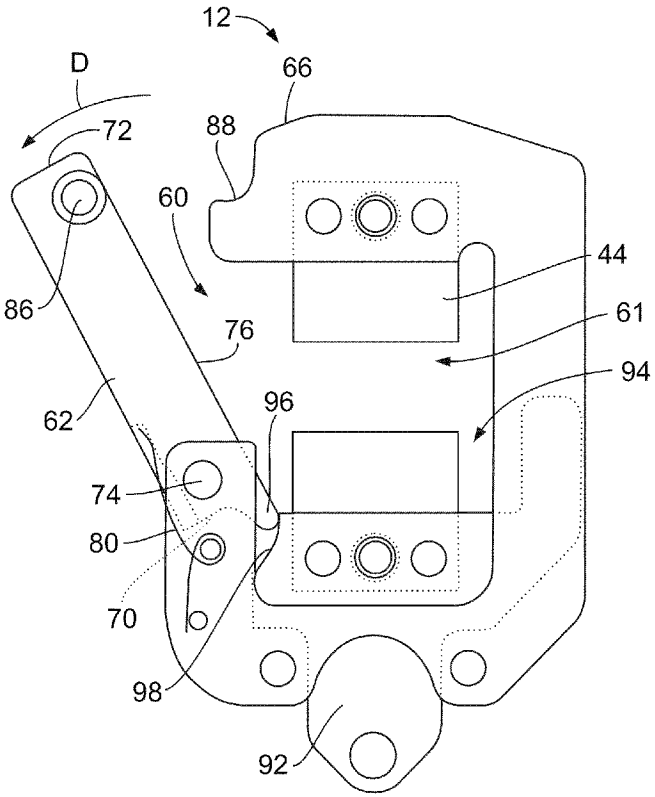
FIG. 3 is a front view of the tool head shown in FIG. 2, with the tool head in an open state.

FIG. 3 is a front view of the tool head 12 with the tool head 12 in an open state. In the open state, the swinging arm 62 is in an open position providing access to the ram cavity 94 and the crimping zone 61. The swinging arm 62 is pivoted from the closed position to the open position in the direction of arrow D. A completed wire assembly (e.g. a terminal and one or more wires) may be ejected or otherwise removed from the ram cavity 94 through the opening 60. For example, the operator may flick the tool head 12 in the direction of the swinging arm 62. Such flicking action may be enough force to open the swinging arm 62. When flicked, the completed wire assembly may be thrown against the swinging arm 62, causing the swinging arm 62 to open. Turning the tool head 12 such that the swinging arm 62 is on the bottom may cause the swinging arm 62 to open from the weight of the swinging arm 62 and/or the completed wire assembly. The operator may pull the completed wire assembly radially outward toward the swinging arm 62, causing the swinging arm 62 to open against the pulling force. In the open position, the distal end portion 72 of the swinging arm 62 is positioned remote or away from the second arm 66. The latching element 86 is no longer connected to the frame latching element 88. A gap is provided between the distal end portion 72 and the second arm 66.

In an exemplary embodiment, a portion of the swinging arm 62 extends into the ram cavity 94 when the swinging arm 62 is in the open position. For example, the pivot end portion 70 includes a cam surface 96 at the end of a lever. Optionally, the cam surface 96 is provided along the inner side 76 of the swinging arm 62. When the swinging arm 62 is pivoted about the pivot pin 74, the cam surface 96 extends into the ram cavity 94. Optionally, the ram 92 may define a stop that limits the opening movement of the swinging arm 62. For example, the swinging arm 62 may be pivoted open until the cam surface 96 engages the ram 92.

In an exemplary embodiment, the ram 92 includes a cam surface 98 that faces the swinging arm 62. The cam surface 98 engages the portion of the swinging arm 62 that is pivoted into the ram cavity 94. The swinging arm 62 is opened until the cam surface 96 engages the cam surface 98. Optionally, the ram 92 may be used automatically close the swinging arm 62 from the open position to the closed position. For example, as the ram 92 is advanced in the advancing direction, the cam surface 98 engages the cam surface 96 to force the swinging arm 62 to rotate to the closed position. The tip of the cam surface 96 may be curved to facilitate rotational movement between the cam surface 96 and the cam surface 98 as the ram 92 is advanced. By automatically closing the swinging arm 62, the crimping tool 10 does not crimp the terminal without the swinging arm 62 being in the closed position. In this manner, the ram 92 prevents damage to the tool head 12 during the crimping operation and/or prevents incomplete crimps due to deflection of the second arm 66 and the fixed die 44 during the crimping operation. Closing the swinging arm 62 using the ram 92 may be an alternative method of closing the swinging arm 62 in addition to, or in the alternative to, the spring 80. For example, the tool head 12 may be provided without the spring 80.

Figure 5:
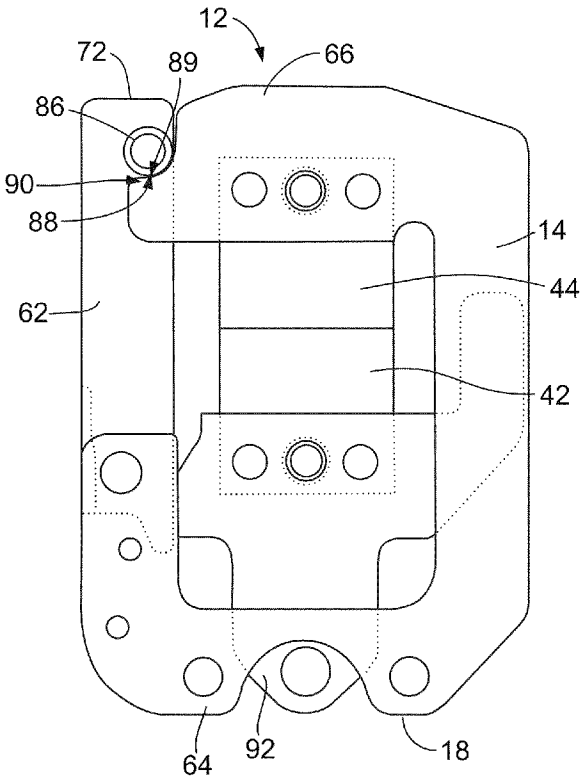
FIG. 5 is a front view of the tool head shown in FIG. 2, with the tool head in a closed, seated state.
Figure 4:
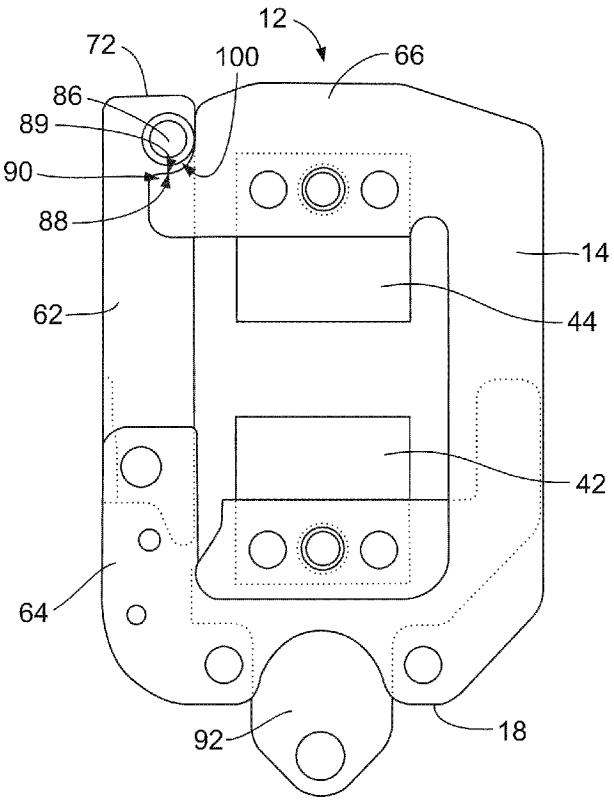
FIG. 4 is a front view of the tool head shown in FIG. 2, with the tool head in a closed, unseated state.

FIG. 4 is a front view of the tool head 12 with the tool head 12 in a closed, unseated state. FIG. 5 is a front view of the tool head 12 with the tool head 12 in a closed, seated state. The tool head 12 is in the closed state when the swinging arm 62 is in the closed position and the latching element 86 is aligned with the frame latching element 88. The distal end portion 72 of the swinging arm 62 engages the second arm 66 of the frame 14 when the swinging arm 62 is in the closed position. The latching element 86 may or may not engage the frame latching element 88 when the swinging arm 62 is in the closed position, depending on the particular embodiment. The tool head 12 is moved from the unseated state to the seated state during the crimping operation, as will be described in further detail below.

The swinging arm 62 is freely movable between the open position and the closed position when the tool head 12 is in the unseated position. The latching element 86 is movable into and out of the frame latching element 88 when the tool head 12 is in the unseated position. For example, the latching element 86 is capable of clearing the flange portion 90 of the frame latching element 88 when the tool head 12 is in the unseated position. In the unseated position, a gap 100 exists between the latching element 86 and the frame latching element 88. The gap 100 may provide some clearance for the latching element 86, such that the swinging arm 62 may be moved from the closed position to the open position.

The tool head 12 is moved from the unseated state to the seated state during the crimping operation. As the ram 92 is advanced, the movable die 42 is forced against the fixed die 44. Continued pressure from the actuator 22 (shown in FIG. 1) on the ram 92 forces the fixed die 44, and thus the second arm 66, outward away from the mating end 18 of the tool frame 14. The frame 14 is spread apart with the second arm 66 deflecting or moving outward away from the first arm 64. As the frame 14 is spread apart, the gap 100 is closed and the flange portion 90 is moved relatively closer to the latching element 86. The second arm 66 is forced outward away from the first arm 64 until the frame latching element 88 engages the latching element 86. The latching element 86 and the swinging arm 62 resist further outward movement of the second arm 66 holding the relative positions of the first and second arms 64, 66 during the crimping operation. The swinging arm 62 provides a link between the first arm 64 and the second arm 66. In the seated position, the flange portion 90 blocks the latching element 86 from moving out of the pocket 89. As such, the latching element 86 is locked with respect to the frame latching element 88. The swinging arm 62 is blocked from moving from the closed position to the open position when the tool head 12 is in the seated state.

In an exemplary embodiment, when the ram 92 is advanced, the ram 92 blocks the swinging arm 62 from opening. For example, the ram 92 is positioned along the inner side 76 of the swinging arm 62. The swinging arm 62 is prevented from pivoting to an open position by the ram 92. In this manner, the ram 92 prevents damage to the tool head 12 during the crimping operation and/or prevents incomplete crimps due to deflection of the fixed die 44 during the crimping operation.

Figure 6:
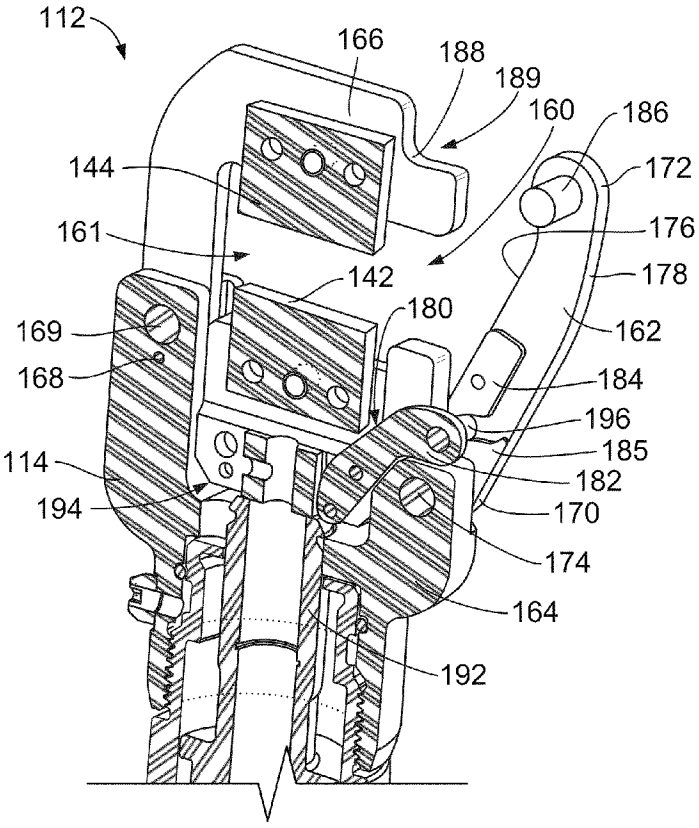
FIG. 6 is a side, partial sectional view of an alternative tool head for the crimping tool shown in FIG. 1.

FIG. 6 is a perspective, partial sectional view of an alternative tool head 112 for the crimping tool 10 (shown in FIG. 1). The tool head 112 includes a tool head frame 114 represents a latching type tool head frame having an opening 160 providing access to a crimping zone 161. The frame 114 also includes a swinging arm 162 that is movable between an open position and a closed position to allow and restrict access, respectively, to the crimping zone 161. The swinging arm 162 is illustrated in the open position. The tool head 112 may be operated in two modes of operation, an auto-open/close mode and an always closed mode. In the auto-open/close mode, the swing arm 162 is automatically opened and closed during operation of the tool 10. In the always closed mode, the swing arm 162 remains closed during the entire stroke of the tool 10.

The frame 114 is generally C-shaped with a first arm 164 and a second arm 166. The first arm 164 defines an inner arm and the second arm 166 defines an outer arm positioned outward or further from the actuator 22 (shown in FIG. 1) than the first arm 164. In the illustrated embodiment, the first and second arms 164, 166 are separate from one another and coupled together using a pin 168. Optionally, the pin 168 may be a shear pin, such that during operation if the forces on the second arm 166 are too great, then the shear pin 168 will shear off and the second arm 166 will become detached from the first arm 164. For example, if the swinging arm 162 fails to latch with the arm 166 prior to crimping, the pin 168 will shear early in the crimp process and allow the arm 166 to pivot around a pivot pin 169, which will open the crimping dies. Such process produces an obviously bad crimp and disables the tool, which forces a repair, and signals to the operator that the bad crimp has occurred and that the terminal should be discarded. The opening 160 is defined between the first and second arms 164, 166.

The swinging arm 162 is coupled to the frame 114 between the first and second arms 164, 166 to close the opening 160. The swinging arm 162 extends between a pivot end portion 170 and a distal end portion 172. The distal end portion 172 is configured to engage the second arm 166 when the swinging arm 162 is in the closed position. The pivot end portion 170 is rotatably coupled to the first arm 164. In an exemplary embodiment, the swinging arm 162 includes a pivot pin 174 extending therefrom at the pivot end portion 170. The swinging arm 162 includes an inner side 176 that faces the crimping zone 161 and an outer side 178 opposite to the inner side 176. Optionally, the inner side 176 may engage the frame 114 when the swinging arm 162 is in the closed position.

In an exemplary embodiment, the tool head 112 includes a biasing member 180 that biases the swinging arm 162 to a closed position. In the illustrated embodiment, the biasing member 180 constitutes a cam follower 182 that is coupled to a ram 192 and the swinging arm 162. The cam follower 182 is used to automatically open and close the swinging arm 162 when the tool head 112 is in the auto-open/close mode. The cam follower 182 is advanced and retracted with the ram 192. In an exemplary embodiment, a first cam 184 is coupled to the swinging arm 162. The cam 184 has a ledge with a curved profile. The cam follower 182 interacts with the cam 184 during operation to change a position of the swinging arm 162 relative to the frame 114. For example, as the cam follower 182 is advanced, the cam follower 182 interacts with the curved profile of the cam 184 and automatically closes the swinging arm 162. For example, the cam follower 182 pulls the swinging arm 162 closed as the cam follower 182 rides along the cam 184. As such, the cam follower 182 operates as a biasing mechanism which forces the swinging arm 162 to the closed position. Additionally, as the cam follower 182 moves to the retracted position, the cam follower 182 interacts with the curved profile of the cam 184 and automatically opens the swinging arm 162. For example, the cam 184 may include a lower part 185 that directs the swinging arm 162 outward as the cam follower 182 engages and rides along the surface of the lower part 185.

In the closed position, the swinging arm 162 may be locked to the second arm 166 during the crimping operation to rigidly hold the second arm 166 relative to the first arm 164. In an exemplary embodiment, the swinging arm 162 includes a latching element 186 and the second arm 166 of the frame 114 includes a frame latching element 188. The latching element 186 and the frame latching element 188 engage one another during the crimping operation to lock the swinging arm 162 and the frame 114. The swinging arm 162 operates as a link between the first arm 164 and the second arm 166 to rigidly close the frame 114. In the illustrated embodiment, the latching element 186 represents a post and the frame latching element 188 includes a pocket 189 that receives the latching element 186.

The tool head 112 includes the ram 192 coupled to the movable die 142. The frame 114 includes a ram cavity 194 between the first and second arms 164, 166. The ram 192 is movable within the ram cavity 194 between a retracted position, such as the position the illustrated in FIG. 6, and an advanced position. As the ram 192 is advanced, the cam follower 182 is also advanced. The cam follower 182 includes a pin 196 that engages the cam 184. As the cam follower 182 is advanced, the pin 196 rides along the surface of the cam 184, forcing the swinging arm 162 to the closed position. Similarly, as the ram 192 is retracted, the cam follower 182 is also retracted. The pin 196 rides along the cam 184 and forces the swinging arm 162 outward to the open position. The cam follower 182 and/or the pin 196 may be manufactured from a compliant material, such as a plastic material, such as for safety. For example, if an operator has a finger blocking the swinging arm 162 from closing during crimping, the cam follower 182 would flex and disengage from the cam 184. As such, a pinch of the operator's finger could be avoided.

Figure 7:
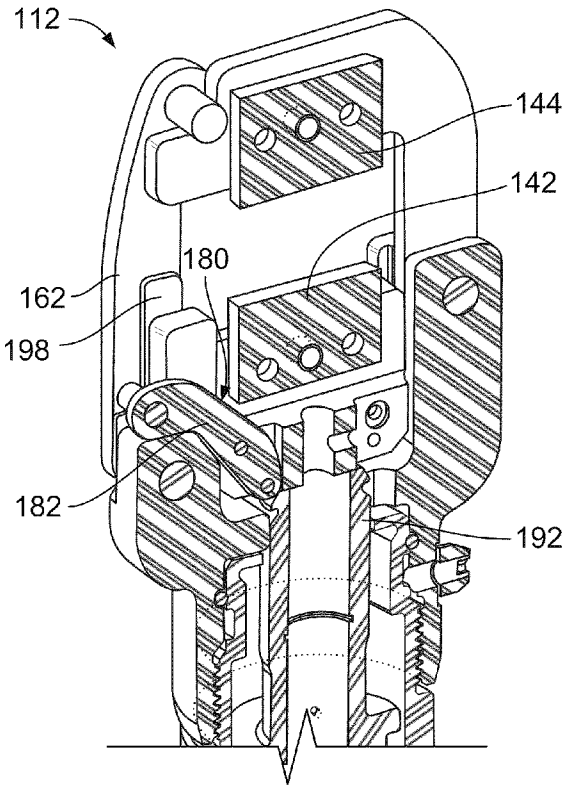
FIG. 7 is another side, partial sectional view of the tool head shown in FIG. 6.

FIG. 7 is another perspective, partial sectional view of the tool head 112 in the always closed mode. In the always closed mode, the swinging arm 162 remains closed as the ram 192 is advanced and retracted. The biasing member 180 biases the swinging arm 162 to the closed position by holding the swinging arm 162 closed. In the illustrated embodiment, the biasing member 180 is represented by the cam follower 182. The cam follower 182 engages a second cam 198 having a different cam profile. The cam profile is linear and vertical. As the pin 196 and cam follower 182 move between the advanced and retracted positions, the pin 196 rides along the second cam 198, which maintains the swinging arm 162 in the closed position.

In an exemplary embodiment, the swinging arm 162 may include both the first and second cams 184, 198. The cam follower 182 may be movable between a first position and a second position to engage the first cam 184 and the second cam 198, respectively. As such, the user may control the mode of operation between the auto-open/close mode and the always closed mode. A selector may be used to select between the modes, which controls the position of the cam follower 182. Alternatively, a selector may be provided that controls a position of the cams 184, 198 as opposed to changing a position of the cam follower 182.

Figure 8:
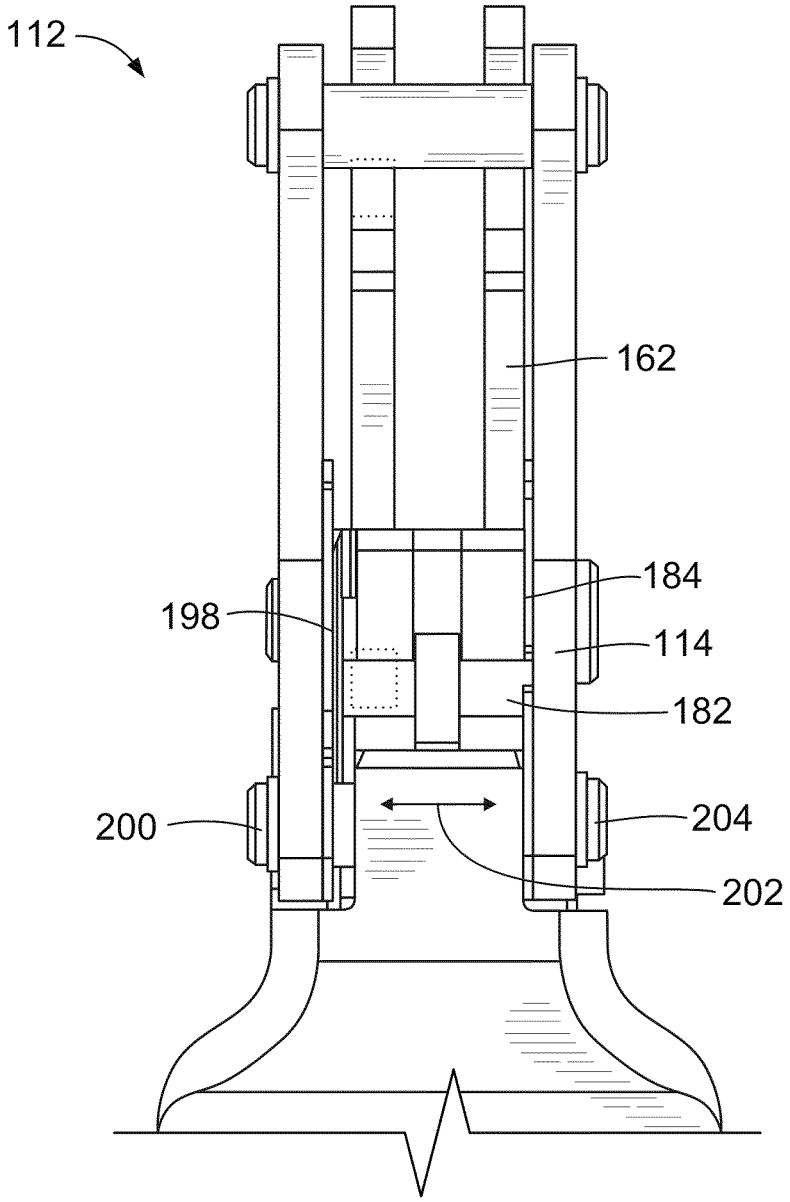
FIG. 8 illustrates another side view of the tool head shown in FIGS. 6 and 7.

FIG. 8 illustrates another side view of the tool head 112. The tool head 112 is illustrated in the auto-open/close mode in which the cam follower 182 engages the first cam 184. The cam follower 182 does not engage the second cam 198.

A selector 200 is provided that moves the position of the cam follower 182 in a mode selection direction, shown by the arrow 202. The selector 200 includes a button 204 that may be pressed by an operator to select the mode of operation. The button 204 extends from both sides of the frame 114 such that the button 204 may be pressed from either side. Pressing on one side moves the selector 200 in one direction and pressing on the other side moves the selector 200 in the other direction. Alternatively, the button 204 may be accessible from only one direction, but may be pressed and depressed, or may be pushed and pulled to allow the selector 200 to move in both directions. Alternatively, rather than moving the cam follower 182, the swinging arm 162 may be moved relative to the cam follower 182, which moves the different cams 184, 198 into and out of engagement with the cam follower 182. The selector 200 may include the pivot pin for the swinging arm 162, which may include detents that control the position of the swinging arm 162 with respect to the frame 114, but still allow pivoting.

Figure 9:
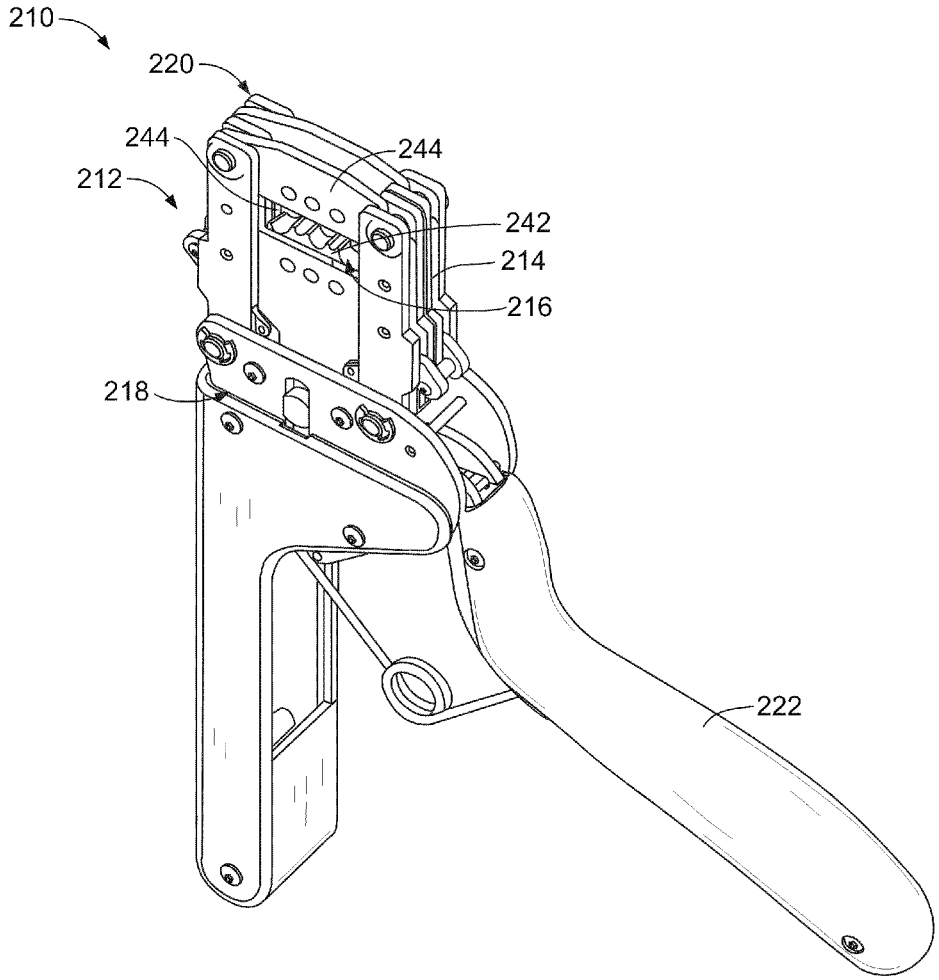
FIG. 9 is a front perspective view of another crimping tool having an alternative crimping head.

FIG. 9 illustrates a crimping tool 210 formed in accordance with an exemplary embodiment. The crimping tool 210 includes a tool head 212 used for crimping components together, such as for crimping a terminal to a wire (not shown). The tool head 212 has a tool head frame 214 holding tooling 216. In an exemplary embodiment, the tool head 212 represents a latching type tool head. The tool head frame 214 may be closed during the crimping operation and opened after the crimping operation to remove the completed wire assembly. The tool head 212 includes a mating end 218 opposite to a head end 220.

The crimping tool 210 includes an actuator 222 represented by a lever or handle that is hand actuated. In an alternative embodiment, the actuator may be hydraulically actuated, such as by using the actuator 22 (shown in FIG. 1).

The tool head frame 214 holds the tooling 216. Optionally, the tooling 216 may be separate from the tool head frame 214 and coupled to the tool head frame 214. The tooling 216 may include first and second crimping dies 242, 244 within a crimping zone. In the illustrated embodiment, the first die 242 represents a movable die that may be referred to hereinafter as a movable die 242 and the second die 244 represents a fixed die that may be referred to hereinafter as a fixed die 244. The movable die 242 is movable with respect to the fixed die 244. Optionally, the tooling 216 may include multiple movable dies or components that are movable toward one another.

The actuator 222 is operated during a crimping operation to move the tooling 216 from a retracted position to an advanced position. For example, the movable die 242 is moved toward the fixed die 244 in an advancing direction. The terminal is crimped to the wire during the crimping operation. After the tooling 216 is fully advanced, the tooling 216 is moved in a retracting direction back to the retracted position.

Figure 10:
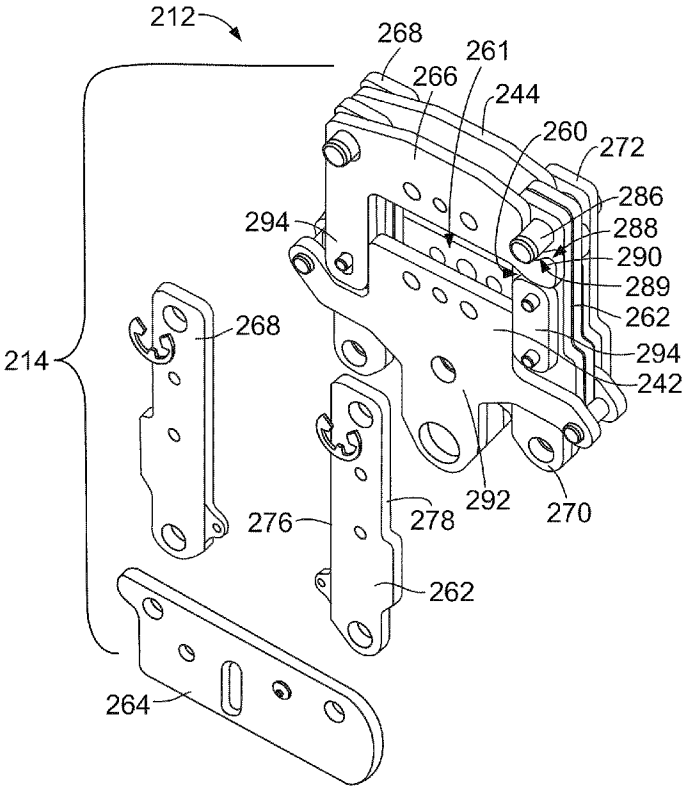
FIG. 10 is a partially exploded view of the tool head shown in FIG. 9.

FIG. 10 is a partially exploded view of the tool head 212 for the crimping tool 210 (shown in FIG. 9). The tool head frame 214 represents a latching type tool head frame 214 having an opening 260 providing access to a crimping zone 261. The frame 214 also includes a swinging arm 262 that is movable between an open position and a closed position to allow and restrict access, respectively, to the crimping zone 261. The swinging arm 262 is illustrated in the closed position. The swinging arm 262 can open to allow the wire(s) and the terminal to eject from the crimping zone 261 after the crimping process.

When assembled, the frame 214 is generally C-shaped with a first arm 264 and a second arm 266. The first arm 264 defines an inner arm and the second arm 266 defines an outer arm positioned outward or further from the actuator 222 (shown in FIG. 9) than the first arm 264. Optionally, the second arm 266 may define the fixed die 244. The opening 260 is defined between the first and second arms 264, 266. A base 268 extends between the first and second arm 264, 266 opposite to the opening 260. The base 268 and first and second arm 264, 266 define the C-shaped body of the frame 214. Optionally, the base 268 may be formed with the first and/or second arms 264, 266. Alternatively, the base 268 may be separate from the first and second arms 264, 266. The arms 264, 266 and the base 268 may each be formed from multiple pieces that are coupled together to form the corresponding arm 264, 266 or base 268. Gaps may be provided between the pieces that receive other pieces, such as pieces forming the movable die 242.

The swinging arm 262 is coupled to the frame 214 between the first and second arms 264, 266 to close the opening 260. The swinging arm 262 extends between a pivot end portion 270 and a distal end portion 272. The swinging arm 262 links both the first and second arms 264, 266 together when the swinging arm 262 is in the closed position. The pivot end portion 270 is rotatably coupled to the first arm 264, such as at a pivot pin (not shown). The swinging arm 262 includes an inner side 276 that faces the crimping zone 261 and an outer side 278 opposite to the inner side 276. Optionally, the inner side 276 may engage the frame 214 and/or the movable die 242 when the swinging arm 262 is in the closed position.

In an exemplary embodiment, a biasing member 280 (shown in FIG. 11) in the form of a spring is positioned between the frame 214 and the swinging arm 262. The spring 280 provides a biasing force on the swinging arm 262 in a biasing direction, shown in FIG. 11 by the arrow E. The spring 280 biases the swinging arm 262 toward the closed position. The spring 280 helps force the swinging arm 262 to the closed position. Optionally, the spring 280 may automatically close the swinging arm 262. Additionally, other types of biasing members, other than the spring, may be used to close the swinging arm 262.

The swinging arm 262 is moved to the closed position prior to or during the crimping operation. The swinging arm 262 is locked to the second arm 266 during the crimping operation to rigidly hold the second arm 266 relative to the first arm 264. In an exemplary embodiment, the swinging arm 262 includes a latching element 286 and the second arm 266 of the frame 214 includes a frame latching element 288. The latching element 286 and the frame latching element 288 engage one another during the crimping operation to lock the swinging arm 262 to the frame 214. The swinging arm 262 operates as a link between the first arm 264 and the second arm 266 to rigidly close the frame 214. In the illustrated embodiment, the latching element 286 represents a post and the frame latching element 288 includes a pocket 289 that receives the latching element 286. The latching element 286 may be cantilevered from the swinging arm 262. Alternatively, both ends of the latching element 286 may be supported by the swinging arm 262. The frame latching element 288 includes a flange portion 290 at a radially outer edge of the pocket 289. The flange portion 290 wraps at least partially around the latching element 286 to hold the latching element 286 within the pocket 289. Alternative latching configurations are possible in alternative embodiments to lock the swinging arm 262 and the second arm 266. For example, the latching element 286 may include a pocket and the frame latching element 288 may include a post received in the pocket. Other types of latches may be used to hold the swinging arm 262 and the second arm 266 together.

The tool head 212 includes a ram 292 coupled to the movable die 242. The ram 292 is also coupled to the actuator 222 (shown in FIG. 9) and is moved by the actuator 222. The ram 292 is movable between a retracted position, such as the position the illustrated in FIG. 10, and an advanced position. The ram 292 drives the movable die 242 towards the fixed die 244 as the ram 292 is moved in the advancing direction to the advanced position. The terminal is crimped to the wire(s) as the movable die 242 is advanced towards the fixed die 244 during the crimping operation. The ram 292 and movable die 242 are also movable along the longitudinal axis in a retracting direction. The frame 214 includes one or more guides 294 that guide the movable die 242 along a linear path in the advancing or retracting directions. Optionally, the guides 294 may form part of the base 268 and the swinging arm 262.

Figure 11:
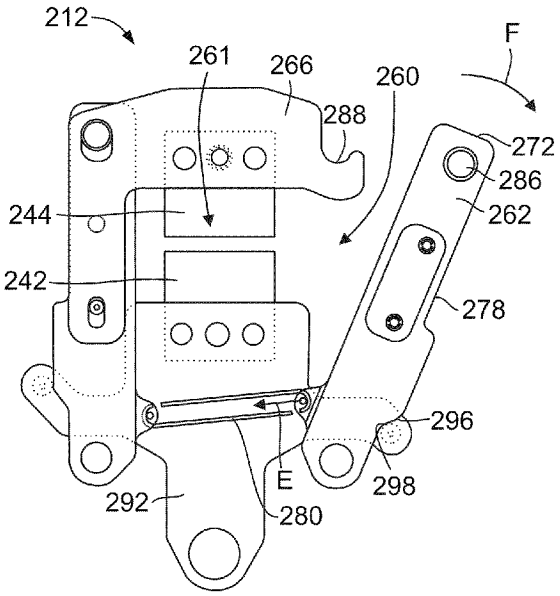
FIG. 11 is a front view of the tool head shown in FIG. 9, with the tool head in an open state.

FIG. 11 is a front view of a portion of the tool head 212 with the tool head 212 in an open state. In the open state, the swinging arm 262 is in an open position providing access to the crimping zone 261. The swinging arm 262 is pivoted from the closed position to the open position in the direction of arrow F. A completed wire assembly (e.g. a terminal and one or more wires) may be ejected or otherwise removed from the crimping zone 261 through the opening 260. In the open position, the distal end portion 272 of the swinging arm 262 is positioned remote or away from the second arm 266. The latching element 286 is no longer connected to the frame latching element 288. A gap is provided between the distal end portion 272 and the second arm 266.

In an exemplary embodiment, a portion of the swinging arm 262 includes a cam surface 296. Optionally, the cam surface 296 is provided along the outer side 278 of the swinging arm 262. The ram 292 includes a cam surface 298 that engages the cam surface 296 of the swinging arm 262. For example, the ram 292 may include a finger that extends through the swinging arm 262 beyond the outer side 278 of the swing arm 262. Optionally, the cam surface 298 is defined by a post that rides along an outer profiled surface of the swinging arm 262. The ram 292 may be used to automatically close the swinging arm 262 from the open position to the closed position. For example, as the ram 292 is advanced in the advancing direction, the cam surface 298 engages the cam surface 296 to force the swinging arm 262 to rotate to the closed position. The profile of the cam surface 296 may be curved to facilitate rotational movement between the cam surface 296 and the cam surface 298 as the ram 292 is advanced. By automatically closing the swinging arm 262, the crimping tool 210 does not crimp the terminal without the swinging arm 262 being in the closed position. In this manner, damage to the tool head 212 during the crimping operation may be prevented and/or incomplete crimping due to deflection of the second arm 266 and the fixed die 244 during the crimping operation may be prevented. Closing the swinging arm 262 using the ram 292 may be an alternative method of closing the swinging arm 262 in addition to, or in the alternative to, the spring 280. For example, the tool head 212 may be provided without the spring 280.

Figure 13:
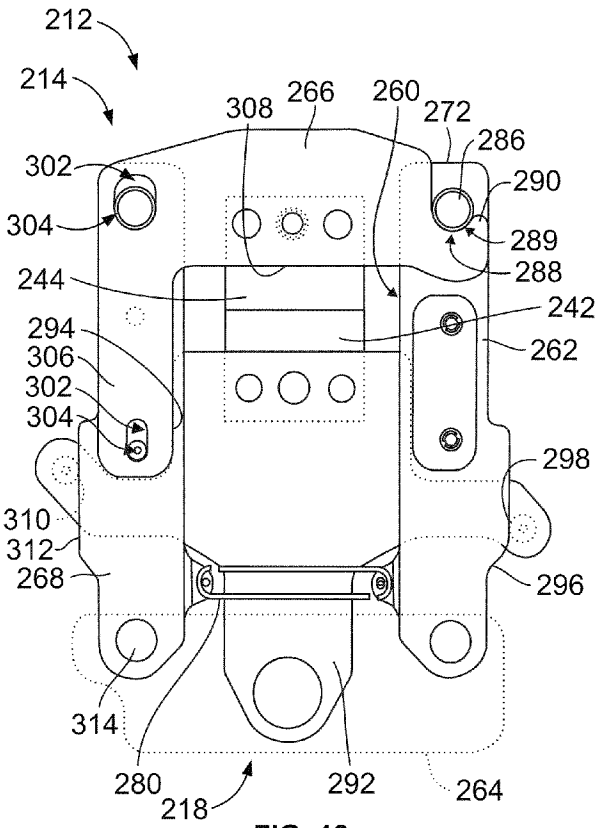
FIG. 13 is a front view of the tool head shown in FIG. 9, with the tool head in a closed, seated state.
Figure 12:
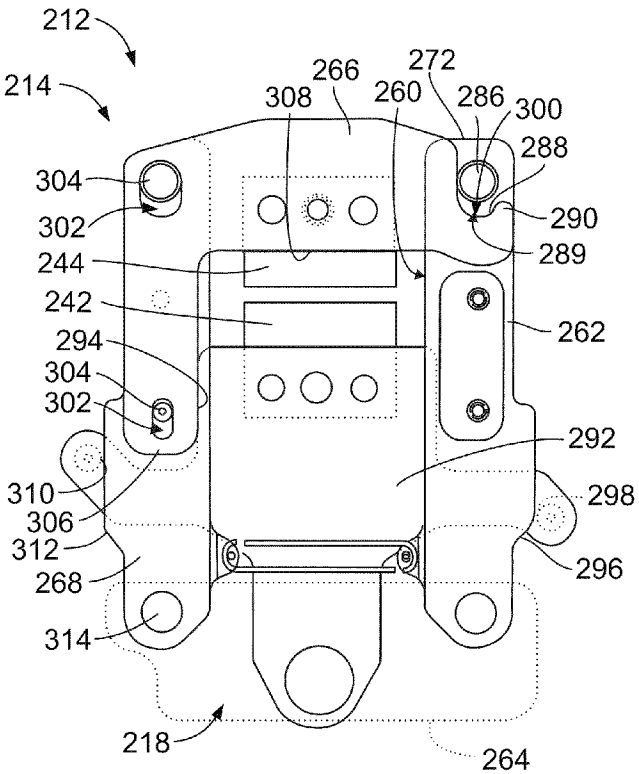
FIG. 12 is a front view of the tool head shown in FIG. 9, with the tool head in a closed, unseated state.

FIG. 12 is a front view of the tool head 212 with the tool head 212 in a closed, unseated state. FIG. 13 is a front view of the tool head 212 with the tool head 212 in a closed, seated state. The tool head 212 is in the closed state when the swinging arm 262 is in the closed position and the latching element 286 is aligned with the frame latching element 288. The distal end portion 272 of the swinging arm 262 engages the second arm 266 of the frame 214 when the swinging arm 262 is in the closed position. In the unseated state, the latching element 286 does not engage the frame latching element 288, but may engage another portion of the second arm 266. In the seated state, the latching element 286 does engage the frame latching element 288. The tool head 212 is moved from the unseated state to the seated state during the crimping operation, as will be described in further detail below.

The swinging arm 262 is freely movable between the open position and the closed position when the tool head 212 is in the unseated position. The latching element 286 is movable into and out of the frame latching element 288 when the tool head 212 is in the unseated position. For example, the latching element 286 is capable of clearing the flange portion 290 of the frame latching element 288 when the tool head 212 is in the unseated position. In the unseated position, a gap 300 (shown in FIG. 12) exists between the latching element 286 and the frame latching element 288. The gap 300 may provide some clearance for the latching element 286, such that the swinging arm 262 may be moved from the closed position to the open position.

The tool head 212 is moved from the unseated state to the seated state during the crimping operation. As the ram 292 is advanced, the tooling held by the movable die 242 is forced against the tooling held by the fixed die 244 and/or the terminals being crimped. Continued pressure forces the fixed die 244, and thus the second arm 266, outward away from the mating end 218 of the tool frame 214. In an exemplary embodiment, the second arm 266 and fixed die 244 are moved linearly outward. For example, the second arm 266 includes one or more guide slots 302 that receive guide posts 304 extending from the base 268. The guide slots 302 are elongated and control the movement of the second arm 266 in a linear direction. As such, the second arm 266 is able to float from the unseated position to the seated position in a linear float direction, with the guide slots 302 and guide posts 304 controlling the floating direction.

In an exemplary embodiment, the second arm 266 includes a finger 306 that extends along the ram 292. The ram 292 blocks the finger 306 from rotating and ensures that the second arm 266 moves in a linear direction parallel to the advancing direction. The finger 306 may define one of the guides 294. The finger 306 may be oriented perpendicular to the main portion of the second arm 266, such that the second arm 266 has a generally L-shape. The second arm 266 is connected to the base 268 at two points to resist rotation of the second arm 266.

During operation, the frame 214 is spread apart with the second arm 266 deflecting or moving outward away from the first arm 264 (shown in phantom). As the frame 214 is spread apart, the gap 300 is closed and the frame latching element 288 is moved relatively closer to the latching element 286. The second arm 266 is forced outward away from the first arm 264 until the frame latching element 288 engages the latching element 286. An inner side 308 of the second arm 266 remains parallel as the second arm 266 is forced outward. In other words, the inner side 308 remains perpendicular to the longitudinal axis along which the movable die 242 is advanced. Because the inner side 308 does not rotate, the crimp tooling 216 (shown in FIG. 9) is properly positioned during the crimping process, which reduces the risk of terminal roll or other problems that lead to improper crimping.

Once the frame 214 is in the seated position, the latching element 286 and the swinging arm 262 resist further outward movement of the second arm 266 holding the relative positions of the first and second arms 264, 266 during the crimping operation. The swinging arm 262 provides a link between the first arm 264 and the second arm 266. In the seated position, the flange portion 290 blocks the latching element 286 from moving out of the pocket 289. As such, the latching element 286 is locked with respect to the frame latching element 288. The swinging arm 262 is blocked from moving from the closed position to the open position when the tool head 212 is in the seated state.

In an exemplary embodiment, when the ram 292 is advanced, the ram 292 blocks the swinging arm 262 from opening. For example, the cam surface 298 of the ram 292 moves along the cam surface 286 and may engage the outer side 278 of the swinging arm 262. The swinging arm 262 is prevented from pivoting to an open position by the ram 292. In this manner, the ram 292 prevents damage to the tool head 212 during the crimping operation and/or prevents incomplete crimps due to deflection of the fixed die 244 during the crimping operation.

In an exemplary embodiment, the ram 292 includes a second cam surface 310, represented by a post, which engages an outer side 312 of the base 268. The second cam surface 310 prevents outward movement of the base 268, such as rotation of the base 268 about a connection point 314 of the base 268 where the base 268 attaches to the first arm 264. In an alternative embodiment, when the ram 292 is in the retracted position, the base 268 and second arm 266 may be allowed to rotate outward about the connection point 314 in a similar manner as the swinging arm 262. As such, the opening 260 may be widened when the frame 214 is in the open state.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A crimping tool comprising:

a frame holding first and second crimping dies within a crimping zone, at least one of the crimping dies being movable during a crimping operation, the frame having a first arm and a second arm, the frame having a base extending between the first and second arms, the base and the first and second arms are formed from a single piece as a unitary body with the base resiliently holding the second arm generally parallel to and fixed relative to the first arm across the crimping zone and with the base resisting rotational movement of the second arm relative to the first arm during the crimping operation, the frame defining an opening opposite the base between the first and second arms, the opening providing access to the crimping zone, the second arm having a frame latching element comprising a depression forming a pocket being open at one side; and a swinging arm having a pivot end pivotably coupled to the first arm of the frame and a distal end opposite to the pivot end, the swinging arm having a latching element being swung into the pocket through the open side with the swinging arm and being configured to engage the frame latching element, the swinging arm being movable between an open position and a closed position, the swinging arm being positioned opposite the base and spanning across the opening to close the opening when the swinging arm is moved to the closed position to restrict access to the crimping zone, the distal end engaging the second arm of the frame when in the closed position to close the opening, wherein the second arm is resiliently biasable away from the first arm during the crimping operation from an unseated position to a seated position, the frame latching element engaging the latching element when in the seated position to limit further movement of the second arm away from the first arm.

2. The crimping tool of claim 1, wherein the latch element of the swinging arm is aligned with and positioned outward from the frame latching element when the swinging arm is in the closed position, the frame latching element being forced outward with the second arm during the crimping operation until the forward latching element is seated against the latching element of the swinging arm.

3. The crimping tool of claim 1, wherein a gap exists between the latching element of the swinging arm and the frame latching element when the swinging arm is in the closed position and the second arm is in the unseated position, the gap being closed as the second arm is transferred to the seated position.

4. The crimping tool of claim 1, wherein the pocket includes a flange portion at an outer edge of the pocket of the frame latching element, the latching element of the swinging arm being freely movable into and out of the pocket of the frame latching element when the second arm is in the unseated position, the flange portion interfering with the latch element of the swinging arm when the second arm is in the seated position to retain the latching element in the pocket of the frame latching element.

5. The crimping tool of claim 1, wherein the second arm includes an elongated guide slot receiving a guide post, the second arm being movable in a linear float direction during the crimping operation wherein the guide post is moved within the guide slot as the second arm is moved in the linear float direction.

6. The crimping tool of claim 1, wherein the frame is C-shaped, the swinging arm linking the first and second arms of the C-shaped frame across the opening of the C-shaped frame to resist widening of the opening between the first and second arms.

7. The crimping tool of claim 1, further comprising a ram operatively coupled to the first crimping die, the second crimping die being coupled to the second arm, the ram driving the first crimping die into the second crimping die, the second arm being forced outward by the ram until the frame latching element is seated against the latching element of the swinging arm.

8. The crimping tool of claim 1, further comprising a ram coupled to the first die, the ram being movable between a retracted position and an advanced position, the ram driving the first die toward the second die as the ram is moved to the advanced position, the ram having a cam follower engaging a cam on the swinging arm when the swinging arm is in the open position to automatically move the swinging arm to the closed position as the ram is moved from the retracted position to the advanced position.

9. A crimping tool comprising:

a frame holding first and second crimping dies within a crimping zone, the frame having a first arm and a second arm, the first and second arms are formed as a single piece, unitary body with the second arm generally parallel to and fixed relative to the first arm across the crimping zone, the frame defining an opening between the first and second arms, the opening providing access to the crimping zone, the second arm having a frame latching element comprising a depression forming a pocket being open at one side;

a ram coupled to the first die, the ram being configured to drive the first die toward the second die;

a swinging arm rotatably coupled to the frame between an open position and a closed position, the swinging arm spanning across the opening to restrict access to the crimping zone and to close the opening in the frame when in the closed position, the swinging arm having a pivot end pivotably coupled to the frame and a distal end opposite to the pivot end, the distal end engaging the frame when in the closed position, the swinging arm having a latching element at the distal end being swung into the pocket through the open side with the swinging arm from the open position to the closed position, the latching element being configured to engage the frame latching element in the closed position; and a biasing member coupled to the swinging arm, the biasing member biasing the swinging arm toward the closed position to close the opening.

10. The crimping tool of claim 9, wherein the biasing member automatically forces the swinging arm to the closed position.

11. The crimping tool of claim 9, wherein the swinging arm is configured to be automatically opened against the biasing member force by a completed wire assembly after a crimping operation of the crimping tool.

12. The crimping tool of claim 9, wherein the swinging arm includes an inner side facing the crimping zone and an outer side opposite to the inner side, the swinging arm includes a pocket open at the outer side, the biasing member being received within the pocket of the swinging arm.

13. A crimping tool comprising:

a frame holding first and second crimping dies within a crimping zone, the frame having an opening providing access to the crimping zone;

a ram coupled to the first die, the ram being configured to drive the first die toward the second die;

a swinging arm rotatably coupled to the frame between an open position and a closed position, the swinging arm closing the opening in the frame when in the closed position, the swinging arm having a pivot end pivotably coupled to the frame and a distal end opposite to the pivot end, the distal end engaging the frame when in the closed position; and a biasing member coupled to the swinging arm, the biasing member biasing the swinging arm toward the closed position to close the opening, wherein the biasing member includes a cam follower engaging the swinging arm when the swinging arm is in the open position to automatically move the swinging arm to the closed position as the ram is moved from a refracted position to an advanced position.

14. The crimping tool of claim 9, wherein the swinging arm is pivotably coupled to the first arm to close the opening, the second arm having a frame latching element and the swinging arm having a latching element configured to engage the frame latching element.

15. The crimping tool of claim 14, wherein the second arm is movable away from the first arm during the crimping operation from an unseated position to a seated position, the frame latching element engaging the latching element when in the seated position to limit further movement of the second arm away from the first arm.

16. The crimping tool of claim 9, wherein the frame is C-shaped with the first arm and the second arm fixed relative to one another, the swinging arm being pivotably coupled to the first arm to engage the second arm.

17. The crimping tool of claim 13, wherein the swinging arm includes a cam, the cam follower engaging the cam to automatically move the swinging arm to the open position as the ram is moved from the advanced position to the retracted position.

18. The crimping tool of claim 13, further comprising a selector that engages and disengages the cam follower from the cam to selectively allow or prevent the automatic opening of the swinging arm.

19. The crimping tool of claim 13, wherein the cam follower is manufactured from a compliant material, the cam follower being configured to be flexed away from the cam during the crimping operation.

20. The crimping tool of claim 13, further comprising a shear pin holding the first arm relative to the second arm, the shear pin being configured to be sheared apart above a predetermined force.

21. The crimping tool of claim 1, wherein the first arm is perpendicular to the base and positioned below the crimping zone, the second arm is perpendicular to the base and positioned above the crimping zone, the base extends along the crimping zone opposite the opening, the base being rigid to maintain the relative positions of the first and second arms.

22. The crimping tool of claim 1, further comprising a ram operably coupled to at least one of the first and second crimping dies.

23. The crimping tool of claim 22, wherein the ram is hydraulically actuated.

24. The crimping tool of claim 22, wherein the ram is hand actuated.

* * * * *